US009370682B2

(12) United States Patent
Piskin et al.

(10) Patent No.: US 9,370,682 B2
(45) Date of Patent: Jun. 21, 2016

(54) EXERCISE EQUIPMENT ASSEMBLY FOR OVERHEAD RESISTANCE

(71) Applicant: Chaise23 Corp., New York, NY (US)

(72) Inventors: Jay Piskin, New York, NY (US); Lauren Piskin, New York, NY (US); Rachel Piskin, New York, NY (US)

(73) Assignee: Chaise23 Corp., New York, NY (US)

( * ) Notice: Subject to any disclaimer, the term of this patent is extended or adjusted under 35 U.S.C. 154(b) by 143 days.

(21) Appl. No.: 14/197,833

(22) Filed: Mar. 5, 2014

(65) Prior Publication Data

US 2014/0274606 A1 Sep. 18, 2014

Related U.S. Application Data

(60) Provisional application No. 61/790,344, filed on Mar. 15, 2013.

(51) Int. Cl.

| | |
|---|---|
| ***A63B 21/04*** | (2006.01) |
| ***A63B 21/02*** | (2006.01) |
| ***A63B 26/00*** | (2006.01) |
| ***A63B 22/14*** | (2006.01) |
| ***A63B 7/00*** | (2006.01) |
| ***A63B 21/055*** | (2006.01) |
| ***A63B 21/16*** | (2006.01) |
| ***A63B 23/12*** | (2006.01) |
| *A63B 23/04* | (2006.01) |

(52) U.S. Cl.

CPC ..... *A63B 21/0442* (2013.01); *A63B 7/00* (2013.01); *A63B 21/0552* (2013.01); *A63B 21/0557* (2013.01); *A63B 21/16* (2013.01); *A63B 23/1245* (2013.01); *A63B 21/4035* (2015.10); *A63B 23/0458* (2013.01)

(58) Field of Classification Search

CPC ..... A63B 21/16; A63B 21/1681; A63B 21/0442; A63B 21/0557; A63B 21/1469; A63B 2021/169; A63B 9/00; A63B 23/0458; A63B 21/169; A63B 21/00185; A63B 21/068; A63B 1/00; A63B 7/00; A63G 9/00; A63G 9/14

USPC ..... 482/129, 143

See application file for complete search history.

(56) References Cited

U.S. PATENT DOCUMENTS

| | | | | |
|---|---|---|---|---|
| 1,744,594 | A * | 1/1930 | Trzesniewski | A63B 9/00 472/118 |
| 3,521,848 | A * | 7/1970 | Ase | A63B 7/02 248/205.1 |
| 7,789,811 | B2 * | 9/2010 | Cooper | A63B 17/00 482/83 |
| 7,967,736 | B2 * | 6/2011 | D'Silva | A63B 21/055 122/123 |
| 8,690,742 | B1 * | 4/2014 | Herman | A63B 21/0414 482/121 |

(Continued)

FOREIGN PATENT DOCUMENTS

| | | | | |
|---|---|---|---|---|
| AT | 12205 U2 * | 1/2012 | | A63B 7/00 |
| WO | WO 2012071061 A1 * | 5/2012 | | A63B 21/00065 |

*Primary Examiner* — Oren Ginsberg
*Assistant Examiner* — Joshua Lee
(74) *Attorney, Agent, or Firm* — Thomas | Horstemeyer, LLP

(57) ABSTRACT

An exemplary embodiment of exercise equipment assembly of the present disclosure utilize a suspension apparatus provide resistance used in various exercise routines. The suspension apparatus is located parallel to and affixed at or below a ceiling of an exercise room such that the apparatus can provide a plurality of attachment points for one or more tensioning devices that are located generally above the position of an exercising user.

12 Claims, 9 Drawing Sheets

(56) References Cited

U.S. PATENT DOCUMENTS

2005/0255971 A1* 11/2005 Solomon ..... A61H 1/0229 482/54
2006/0084556 A1* 4/2006 Payne ..... A63B 21/0552 482/121
2011/0172064 A1* 7/2011 Cutler ..... A63B 21/0552 482/63
2011/0237410 A1* 9/2011 Perez ..... A63B 21/0557 482/129
2012/0142506 A1* 6/2012 Hetrick ..... A63B 23/1218 482/142
2012/0214651 A1* 8/2012 Ross ..... A63B 21/0442 482/129
2013/0069328 A1* 3/2013 Hetrick ..... B60B 33/0005 280/79.11
2013/0143724 A1* 6/2013 DeMeo ..... A63B 21/00185 482/131
2014/0054247 A1* 2/2014 Scaramucci ..... A63B 1/005 211/13.1

* cited by examiner

EXERCISE EQUIPMENT ASSEMBLY FOR OVERHEAD RESISTANCE

CROSS-REFERENCE TO RELATED APPLICATION

This application claims priority to U.S. provisional application entitled, "Exercise Equipment Assembly for Overhead Resistance," having Ser. No. 61/790,344, filed Mar. 15, 2013, which is entirely incorporated herein by reference.

TECHNICAL FIELD

The present disclosure is generally related to fitness and exercise equipment and related apparatuses.

BACKGROUND

The exercise method developed by Joseph H. Pilates in the early twentieth century involves many different exercises utilizing a variety of specially designed equipment for a body conditioning routine that is designed to help build flexibility, muscle strength and endurance in the legs, abdominals, arms, and back. The Pilates approach is intended to develop a strong core or center of the body and in improving condition and balance. The Pilates approach allows for various exercises to be modified in a range of difficulty from beginning to advanced, usually by increasing resistance. The Pilates method seeks to develop controlled movement from a strong core using a range of apparatus to guide and train the body.

Joseph Pilates' preferred name for his exercise method was "contrology." He used this term to indicate the importance of muscle control during the exercise. All exercises are done with control over the muscles being exercised such that the muscles work against gravity or resistance in a smooth and controlled manner. The focus is on doing one precise and perfect movement, rather than many half-hearted ones. The goal is for the precision to eventually become second nature.

Although Joseph Pilates originally developed a method of mat exercises borrowing many skills from yoga, he also used several pieces of apparatuses, each with its own repertoire of exercises. Most of these exercises involved principles of resistance training using springs or other methods of applying various amounts of resistance to the movement of the exercise. The most widely used piece of apparatus is the Reformer. Other apparatus included the Pilates chair or "wunda chair," the Cadillac, and the Ladder Barrel.

The Pilates chair features a hinged pedal element to which differing amounts of tension can be applied by adjusting the springs affixed to the chair. The user places a part of its body onto the pedal and applies pressure against the pedal to accomplish resistance based exercises. The Pilates chair, however, is traditionally considered to be one of the most difficult and inaccessible pieces of Pilates apparatus because it is difficult to use, especially for an injured user.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
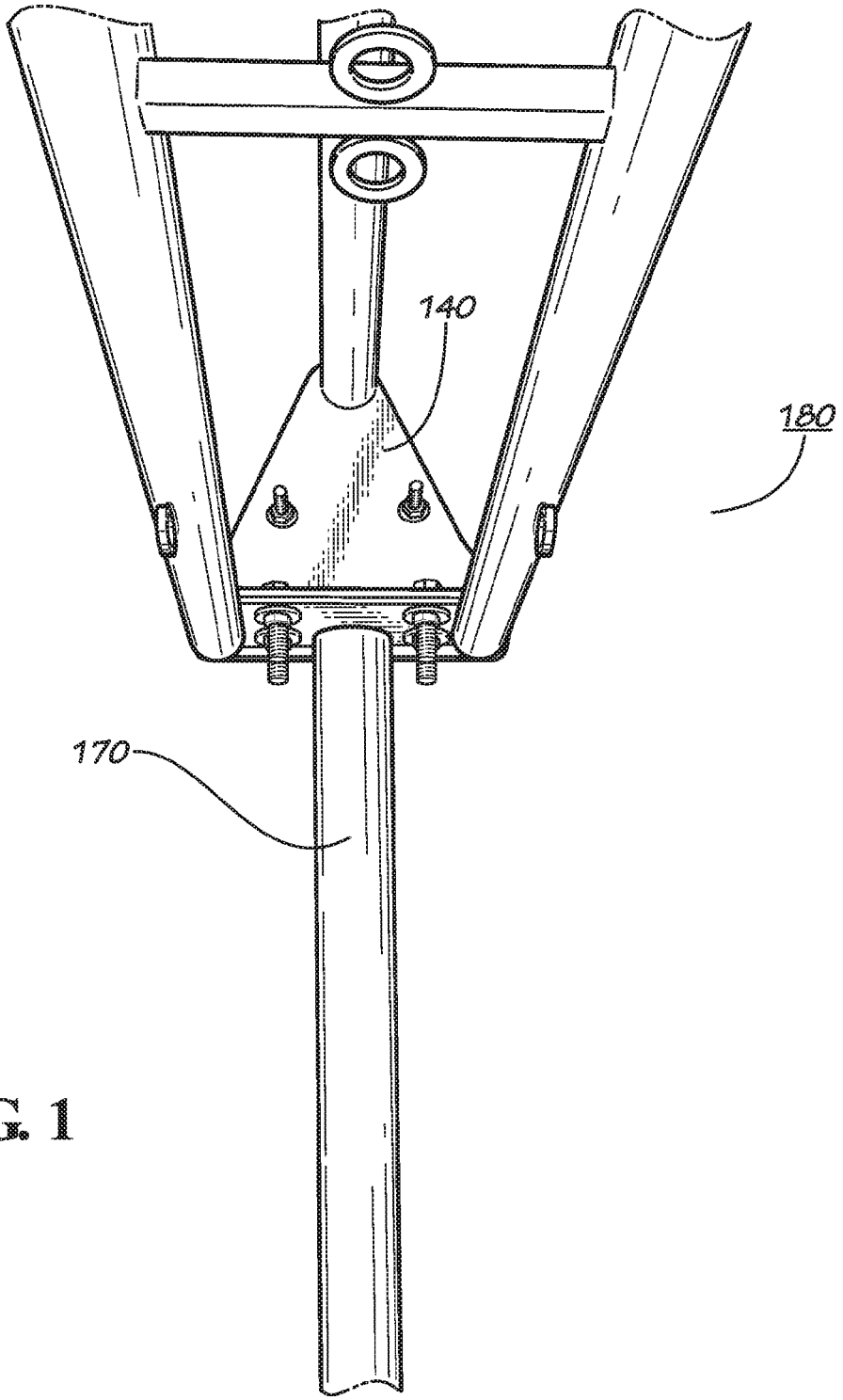
FIGS. 1-9 are diagrams of various embodiments of an exercise equipment assembly in accordance with the present disclosure.
Figure 2:
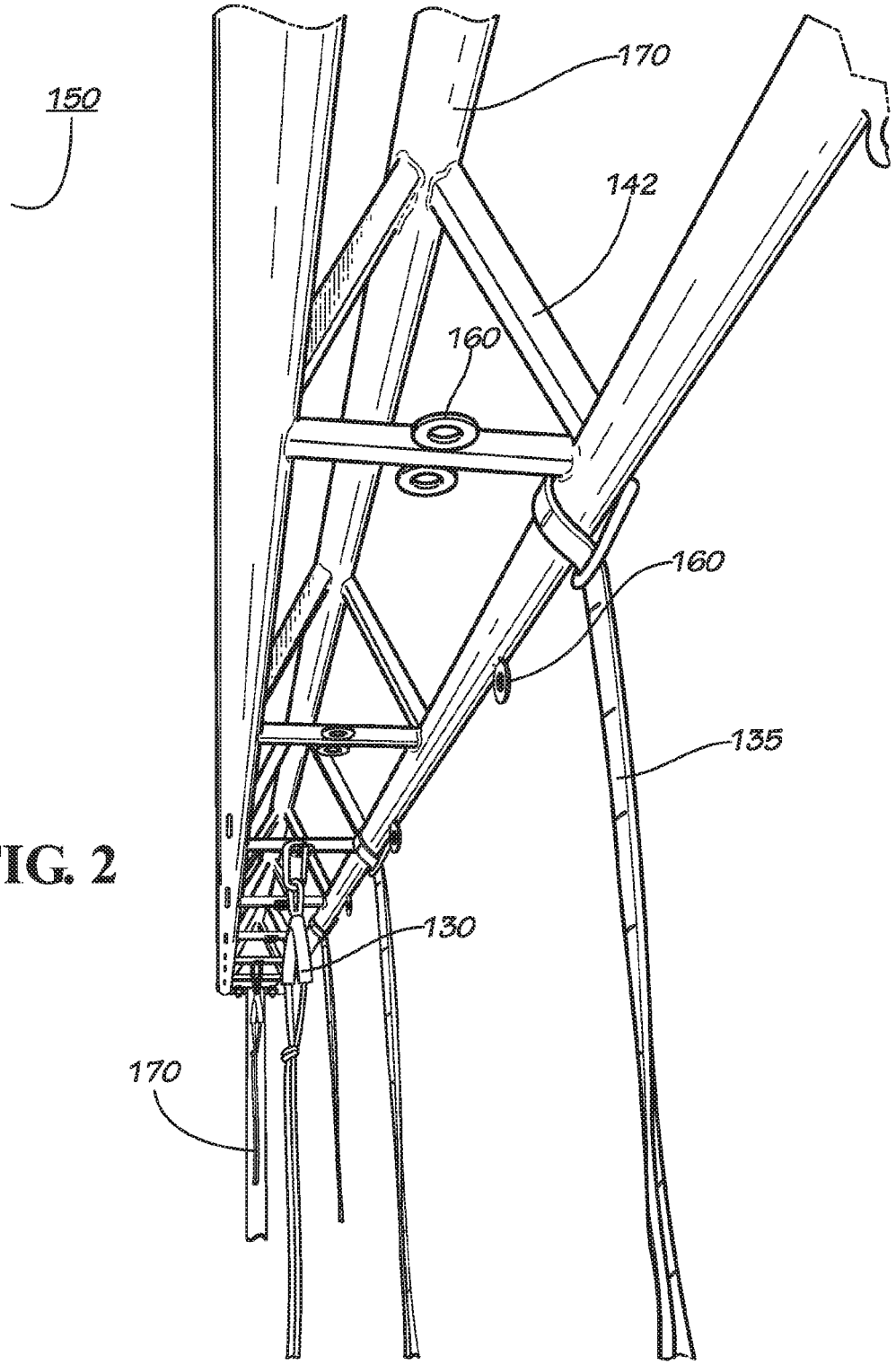
Figure 4:
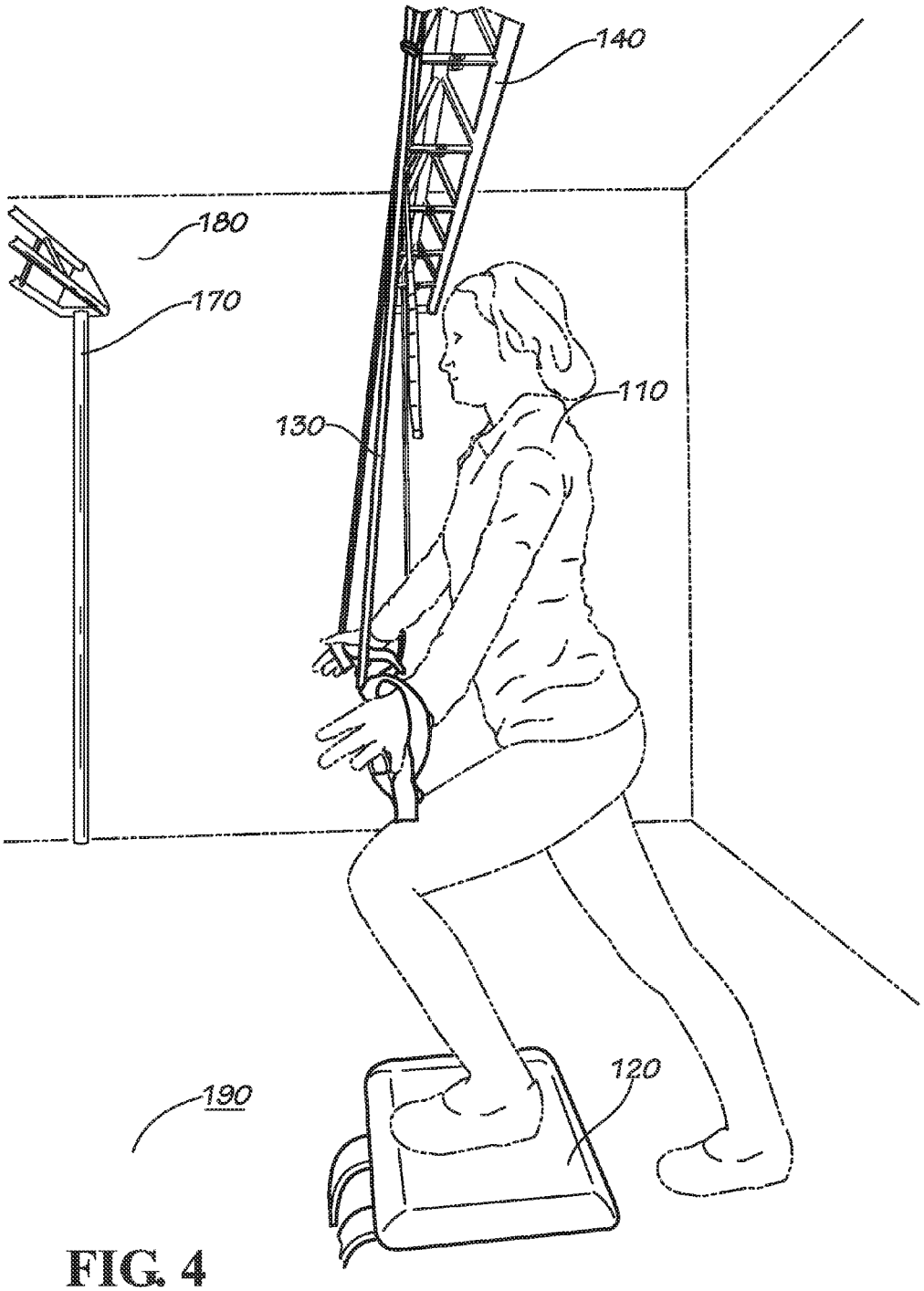

Various embodiments of an exercise equipment assembly of the present disclosure utilize a suspension apparatus 140 (FIG. 1) to provide resistance used in various exercise routines. In one embodiment, the suspension apparatus 140, such as a truss, is located parallel to and below a ceiling 150 (FIG. 2) of an exercise room such that the apparatus 140 can provide a plurality of attachment points 160 (FIG. 2) for one or more tensioning devices 130 (FIG. 1), such as a bungee cord or Thera-Band (e.g., latex resistance band or tube), that are located generally above the position of an exercising user 110. The suspension apparatus 140 can be supported by vertical poles 170 (FIG. 1) that are attached to the wall 180 (FIG. 4) or rest on the floor 190 of the exercise room as shown in FIGS. 1-2 and 4. These poles 170 can be of varying heights.

Figure 3:
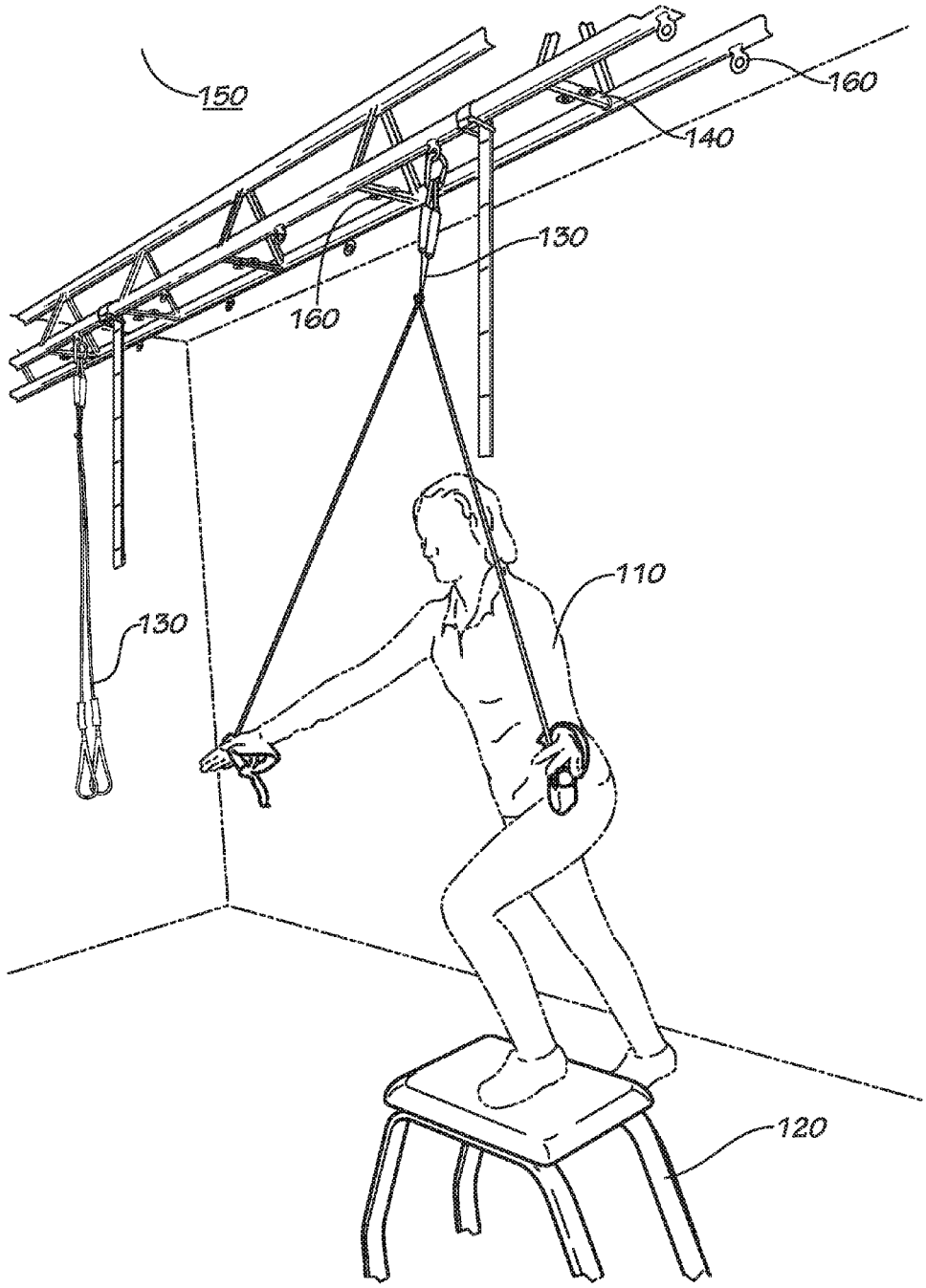

As discussed above, via the suspension apparatus 140, at least one tensioning device 130, such as a bungee cord or Thera-Band, may be attached to various points above or to the side of an exercising user. In one embodiment, as shown in FIGS. 3-4, a user 110 may place a part of his/her body on a Pilates chair or "wunda chair" 120 (FIG. 3) positioned beneath one or more tensioning devices 130 affixed to various points on the suspension apparatus 140 suspended below the ceiling 150. Simultaneously grasping one or more of the tensioning devices 130 hanging down from the suspension apparatus 140 permits the user 110 to perform a plurality of exercise movements against resistance from both above and below the user's position. In another embodiment, the tensioning device(s) 130 can be used from a standing, sitting, or reclined position without the Pilates chair 120.

Figure 5:
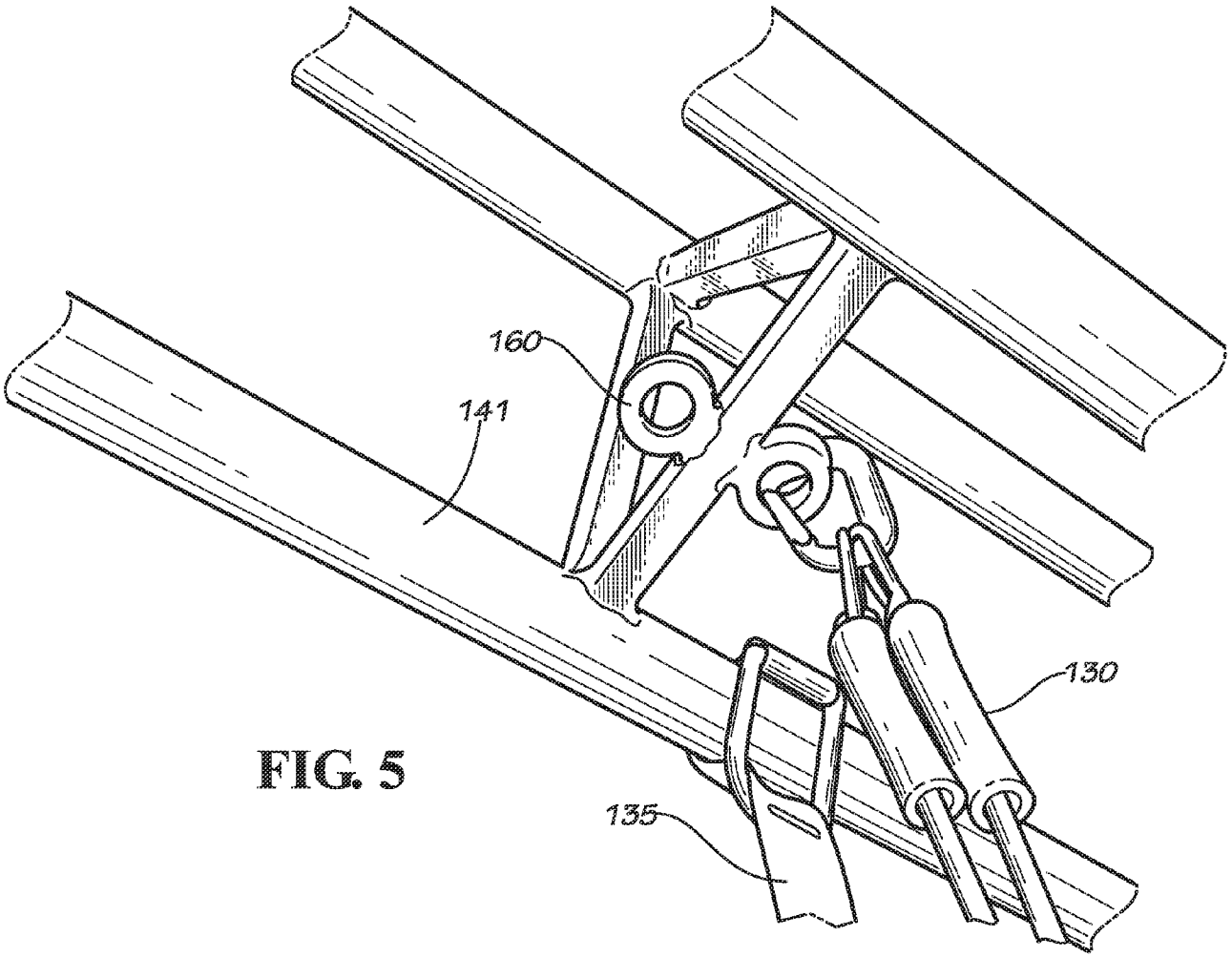

The overhead suspension apparatus 140 incorporates a plurality of attachment points 160 along its length to which tensioning device(s) 130, such as bungee cords, can be attached. One type of attachment point 160 includes circular eyehooks, as illustrated in FIG. 5 which allow a tensioning device 130 to be attached to a fixed point located generally above the area in which the user will exercise. Tensioning device(s) 130 can also be affixed to the horizontal pipe elements 141 of the suspension apparatus 140, as shown in FIG. 5.

Figure 6:
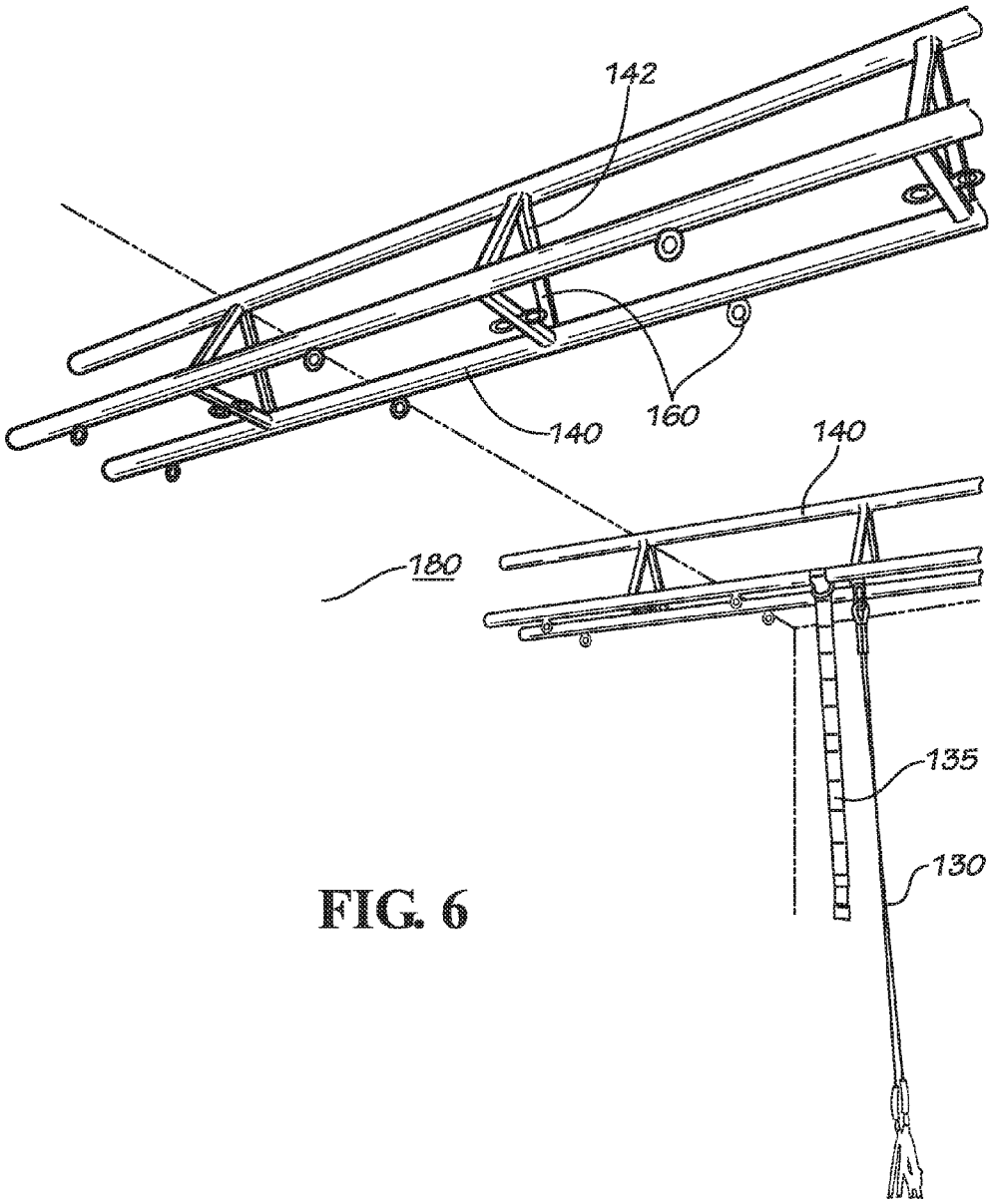
Figure 7:
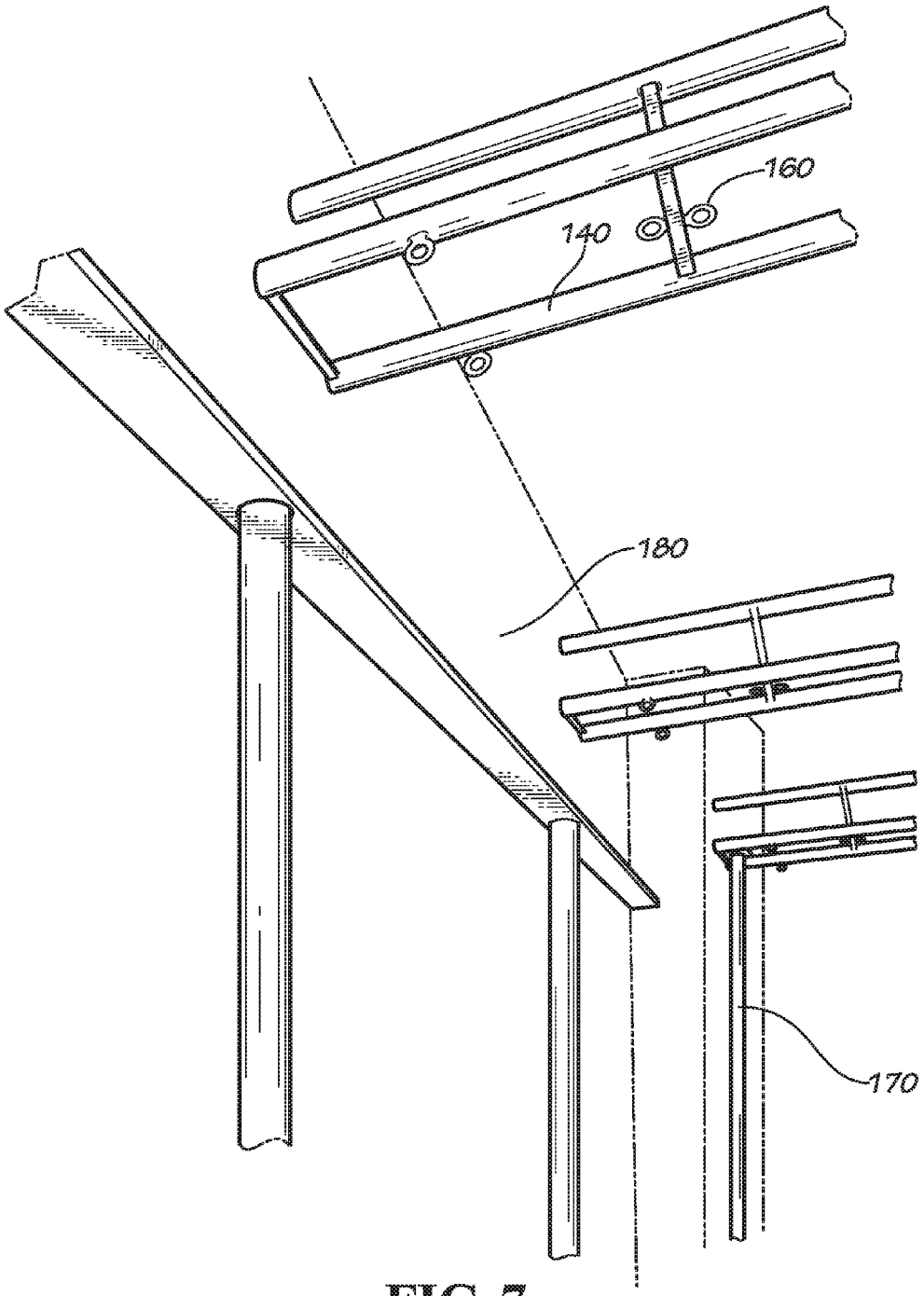

The suspension apparatus 140 can be composed of pipes 142 arranged in a triangular shape, as shown in FIG. 2 and FIG. 6 or could be of a different configuration, such as a square or rectangle, so long as the resulting suspension apparatus provides sufficient strength and stability to permit a number of users to simultaneously stress the tensioning devices 130 attached to the suspension apparatus 140 without altering the location of the attachment points 160. Alternatively, the suspension apparatus 140 could be suspended from the ceiling 150 or embedded into the walls 180 of the room, as shown in FIGS. 6-7.

The traditional Pilates chair exercise routine provides an effective lower body workout by providing resistance from below the user's position. The addition of one or more tensioning devices 130 provides resistance from above the user 110 (FIG. 3), adding a new element of upper body conditioning. In addition, the tensioning device(s) 130 of the various embodiments also facilitate a more open body position consistent with better posture during exercise. A user 110 exercising on a traditional Pilates chair 120 may tend to assume a hunched over or closed position lower to the chair 120 to maintain its balance. Use of a tensioning device 130 of the present disclosure provides the user 110 with support from above enabling the user 110 to assume a better posture during exercise. At the same time, the resistance from above provided by the tensioning device 130 enables the user 110 to stretch or lengthen the user's spine resulting in the user 110 achieving a longer, leaner, and toned physique. Because the exercise equipment assembly of the present disclosure provides support for the user 110, it enables users who might otherwise have difficulty using the Pilates chair 120 because of injury or age to benefit from an exercise program using it. The addition of the tensioning device(s) 130 to an exercise routine using a Pilates chair 120 also results in an increased caloric burn rate during the exercise routine.

In another embodiment, the Pilates chair 120 is removed and the user 110 engages the tensioning device(s) 130 while standing, sitting, or reclining beneath them. In this embodiment, a tensioning device 130 can be grasped by the user's arms or attached by stirrups or the like to his or her feet, so that they can be used to provide various types of resistance to the user 110 as they perform a variety of controlled dance-like movements. In this manner, the tensioning device(s) 130 provide both support and resistance that helps stabilize flexible ballet-like dance movements, thus promoting the engagement of the body's core muscles, assisting maintenance of proper posture, as well as chest expansion, alignment, and balance. In one embodiment, as one or more tensioning devices 130 are pulled downwards from their attachment points 160, the user engages his/her core muscle groups, lengthening the spine of the user, and strengthening their spinal, upper back, and chest muscles. Use of tensioning device(s) 130 suspended over the head of the user 110 allows the user to jump higher during exercise movements due to the lift of the tensioning device 130.

Whether used with or without a Pilates chair 120, the tensioning devices 130 of an embodiment of the present disclosure, when oriented in line with the user's spine, provide equal resistance to the user's body, promoting posture, alignment, and balance. Exercise movements using the exercise equipment assembly with tensioning device(s) 130 can also open tight pectoral muscles, relieving neck, and shoulder pain. Each of the user's exercise moves, whether a press and release, a held press, or a pulse, results in a controlled exercise movement against resistance.

Embodiments of the suspension apparatus 140 permit the user 110 to precisely determine both the angle and strength of the resistance to be provided to any movement that the user 110 may wish to use as part of a resistance based exercise regimen. The multiple fixture points along the suspension apparatus 140 provide the user 110 with precise control over the angle and height from which resistance is applied to various exercise movements and the amount of resistance provided. Attaching a tensioning device 130 at a higher height will limit the total range of motion of the exercise movement and increase the strength required to extend the tensioning device 130 to its full extension point. Attaching that tensioning device 130 at a lower level will increase the range of motion and decrease the amount of resistance required to extend the tensioning device 130 to its full extension point.

In yet another embodiment of the present disclosure, the length of the tensioning device 130 can be extended below the attachment point 160 on the suspension apparatus 140 using a length of chain, rope, or an extension strap 135 (FIG. 2). Extending the length of the tensioning device 130 allows for an extended range of motion such that the circumference of movement around the Pilates chair 120 below the tensioning device(s) 130 is increased. Also, the variable movement and instability of the extended mount as opposed to a static mount increases the difficulty with respect to all exercises, since it increases muscle engagement while the user is attempting to stabilize his/her body during the exercise.

Figure 8:
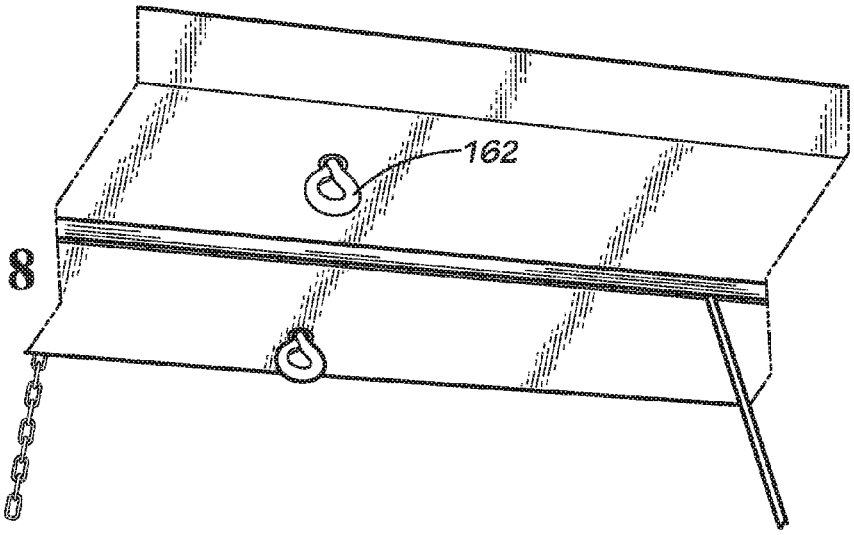
Figure 9:
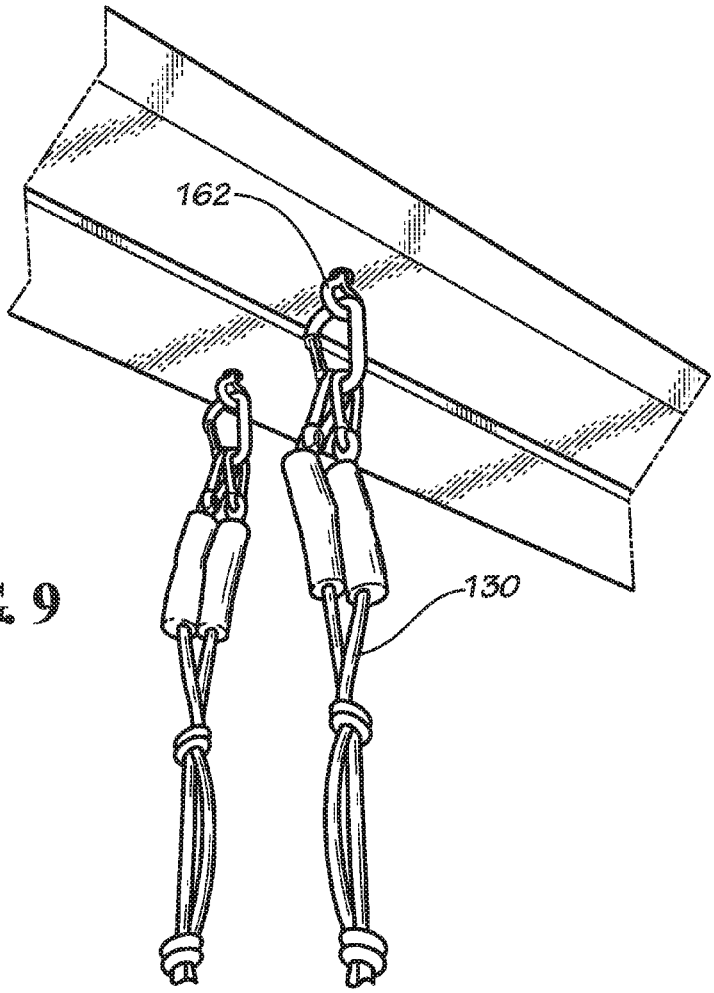

In yet another embodiment, attachment points 162 (FIG. 8) for the tensioning devices 130 are affixed to strengthened points on the wall 180 of the exercise room, below the ceiling 150 but generally above and to the side of an average user 110, as illustrated in FIG. 8. A close-up of an exemplary wall-mounted attachment point 162 is shown in FIG. 9.

Wall positioned attachment points 162 allow the user to apply resistance from the side, thus changing the angle of the resistance compared to a ceiling mounted attachment point 160. This enables the user to exercise in a seated, kneeling, or reclined position, either using a Pilates chair 120 or on the floor, thus working the muscles differently than when using one or more tensioning devices 130 affixed to overhead attachment points 160. A side mounted tensioning device may also assist the user 110 in stabilizing the body of the user, thus permitting the user 110 to perform certain types of exercise movements that he/she could not perform without such stabilization due to the limitations of the user's balance. The ability of embodiments of the exercise equipment assembly to add stability to exercise movements enables the user 110 to strengthen the user's back, spinal, and chest muscles and increase the spinal health of the user.

Figure 10:
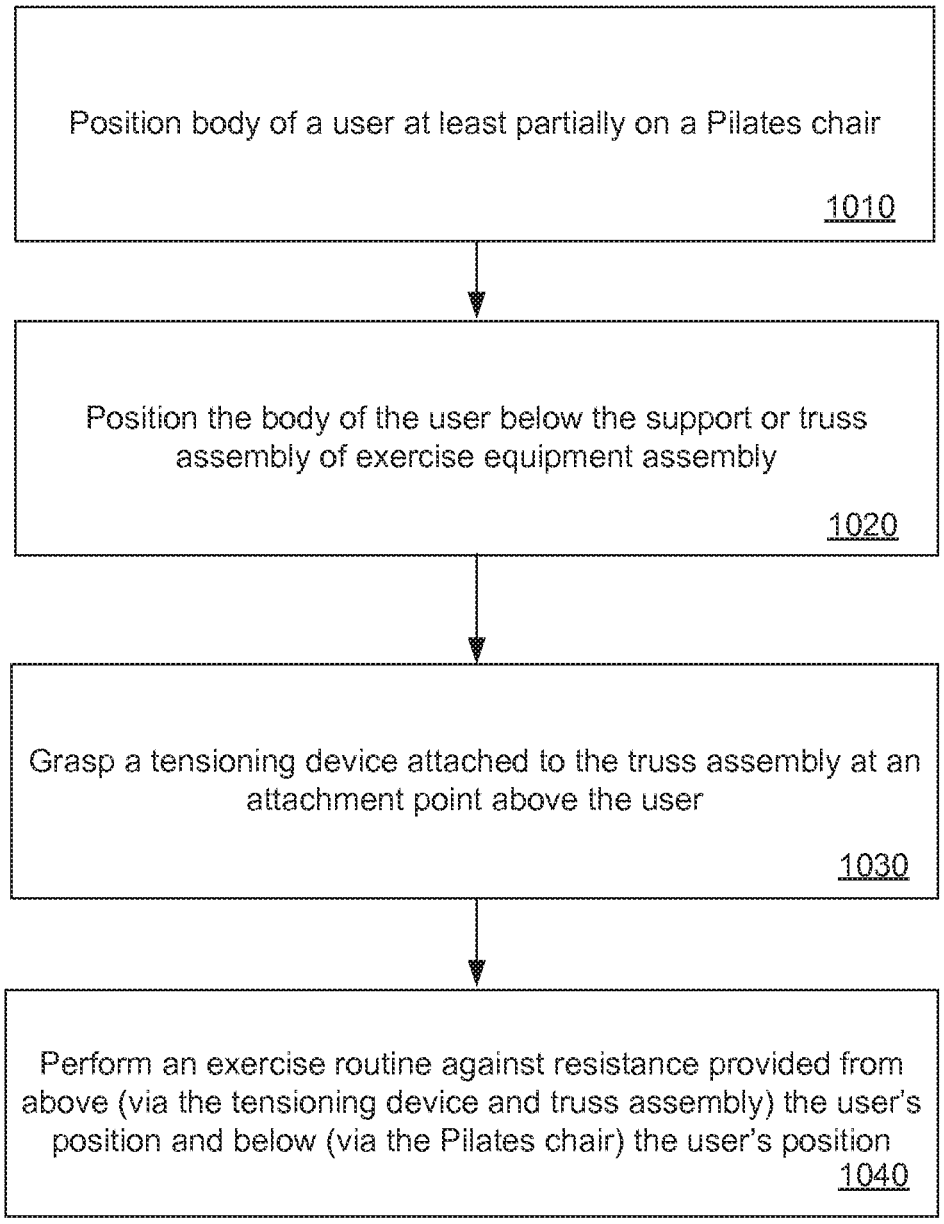
FIG. 10 is a flow chart diagram of an exemplary method in accordance with the present disclosure.

Referring now to FIG. 10, a flow chart describing an exemplary embodiment of a method in accordance with the present disclosure begins with a user 110 positioning (1010) his or her body at least partially on a Pilates chair 120. In concert, the user 110 positions (1020) his or her body below the suspension apparatus 140 of the exercise equipment assembly. The user 110 may then grasp (1030) a tensioning device 130 attached to the suspension apparatus 140 at an attachment point 160 above the user 110. Then, the user 110 performs (1040) an exercise routine against resistance provided from above (via the tensioning device 130 and suspension apparatus 140) the user's position and below (via the Pilates chair 120) the user's position. In another embodiment, the exercise routine can be used from a standing, sitting, or reclined position without the Pilates chair.

Any process descriptions or blocks in flow chart(s) should be understood as representing alternate implementations in which functions may be executed out of order from that shown or discussed, including substantially concurrently or in reverse order, depending on the functionality involved, as would be understood by those reasonably skilled in the art of the present disclosure.

It should be emphasized that the above-described embodiments are merely possible examples of implementations, merely set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure.

Therefore, having thus described various embodiments, at least the following is claimed:

1. An exercise method comprising:

positioning a body of a user at least partially on a Pilates wunda exercise chair;

positioning the body below a suspension apparatus of an exercise equipment assembly;

engaging a tensioning device attached to the suspension apparatus at an attachment point above the user, wherein the attachment point comprises a closed circular ring adapted to anchor the tensioning device at an immovable position with respect to the suspension apparatus; and performing an exercise routine against resistance from above a position of the user, via the suspension apparatus and the tensioning device, and below the position of the user, via the Pilates wunda exercise chair.

2. The exercise method of claim 1, wherein the tensioning device comprises a bungee exercise cord or a latex resistance band.

3. The exercise method of claim 1, wherein the suspension apparatus via the tensioning device supports the user from above as the user exercises on the Pilates wunda exercise chair.

4. The exercise method of claim 1, further comprising changing an angle of resistance applied to the tensioning device by attaching the tensioning device to at least one secondary attachment point.

5. An exercise method comprising:

orienting a user's body under a suspension apparatus, wherein the suspension apparatus extends above a height of a user across an exercise room;

performing a controlled exercise movement;

enabling resistance against the user's body as the user engages at least one tensioning device attached to the suspension apparatus at an attachment point above the user's body and performs the controlled exercise movement, wherein the suspension apparatus provides a plurality of attachment points at varying heights to which the at least one tensioning device can be fastened to provide the user with precise control over an angle and height from which resistance is applied to various exercise movements, wherein the plurality of attachment points comprises the attachment point, each attachment point comprising a closed circular ring adapted to anchor the at least one tensioning device at an immovable position with respect to the suspension apparatus; and enabling resistance against the user's body by supporting at least part of a weight of the user's body against a Pilates wunda exercise chair positioned below the suspension apparatus.

6. The exercise method of claim 5, further comprising changing an angle of resistance applied to the at least one tensioning device by fastening the at least one tensioning device to a secondary attachment point.

7. The exercise method of claim 6, wherein the secondary attachment point is mounted to a sidewall of the exercise room at a height below the suspension apparatus.

8. The exercise method of claim 5, wherein a cross-section of the suspension apparatus is composed of horizontal pipes arranged in a triangular shape.

9. The exercise method of claim 5, further comprising providing overhead resistance with a second user's body that is positioned on a floor in a seated, kneeling, or reclined position.

10. The exercise method of claim 5, wherein the suspension apparatus extends from one side of the exercise room to an opposite side of the exercise room, the method further comprising orienting a second user's body under the suspension apparatus for exercise along with the user's body.

11. The exercise method of claim 5, wherein the at least one tensioning device comprises a bungee exercise cord or a latex resistance band.

12. The exercise method of claim 5, wherein the suspension apparatus extends from one side of the exercise room to an opposite side of the exercise room.

* * * * *